US010347994B2

(12) United States Patent
Cho et al.

(10) Patent No.: US 10,347,994 B2
(45) Date of Patent: Jul. 9, 2019

(54) PATTERN/POLARIZED ANTENNA DEVICE AND BEAMFORMING METHOD

(71) Applicant: Korea Advanced Institute of Science and Technology, Daejeon (KR)

(72) Inventors: Dongho Cho, Daejeon (KR); Changbae Yoon, Daejeon (KR); Daehee Park, Daejeon (KR); Ju Yong Lee, Daejeon (KR); Gye-Tae Gil, Daejeon (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 388 days.

(21) Appl. No.: 15/110,921

(22) PCT Filed: Jan. 23, 2015

(86) PCT No.: PCT/KR2015/000759

§ 371 (c)(1),
(2) Date: Jul. 11, 2016

(87) PCT Pub. No.: WO2016/117734

PCT Pub. Date: Jul. 28, 2016

(65) Prior Publication Data

US 2016/0359240 A1 Dec. 8, 2016

(30) Foreign Application Priority Data

Jan. 23, 2015 (KR) ..... 10-2015-0011156

(51) Int. Cl.
*H01Q 3/24* (2006.01)
*H01Q 3/26* (2006.01)
(Continued)

(52) U.S. Cl.
CPC ..... *H01Q 25/002* (2013.01); *H01Q 3/24* (2013.01); *H01Q 3/26* (2013.01); *H01Q 9/0407* (2013.01);
(Continued)

(58) Field of Classification Search
CPC .... H01Q 25/002; H01Q 21/061; H01Q 21/08; H01Q 21/24
See application file for complete search history.

(56) References Cited

U.S. PATENT DOCUMENTS 4,839,663 A 6/1989 Kurtz
6,426,723 B1 * 7/2002 Smith ..... H01Q 1/22 343/700 MS
(Continued)

FOREIGN PATENT DOCUMENTS

JP 2007-013318 A 1/2007
JP 2014-195238 A 10/2014
(Continued)

OTHER PUBLICATIONS

Office Action for Japanese Patent Application No. JP 2015-563091, dated Jan. 24, 2017, 6 Pages.
(Continued)

*Primary Examiner* — Daniel Munoz
(74) *Attorney, Agent, or Firm* — Fenwick & West LLP

(57) ABSTRACT

In an N-port pattern/polarized antenna device, two-type antenna elements are configured to have a radiation pattern to use a spherical vector wave mode with at least N orders, the antenna elements being arranged at intervals not larger than a half wavelength between them. The antenna elements comprise electric field antennas with a radiation pattern distributed in an even mode among the spherical vector wave mode, and magnetic field antennas with a radiation pattern distributed in an odd mode, the electric field antennas and the magnetic field antennas being integrated to face a different direction, each other.

3 Claims, 8 Drawing Sheets

(51) Int. Cl.

| | |
|---|---|
| ***H01Q 9/04*** | (2006.01) |
| ***H01Q 13/08*** | (2006.01) |
| ***H01Q 13/10*** | (2006.01) |
| ***H01Q 21/06*** | (2006.01) |
| ***H01Q 21/08*** | (2006.01) |
| ***H01Q 21/24*** | (2006.01) |
| ***H01Q 25/00*** | (2006.01) |

(52) U.S. Cl.
CPC ..... *H01Q 13/08* (2013.01); *H01Q 13/10* (2013.01); *H01Q 21/061* (2013.01); *H01Q 21/08* (2013.01); *H01Q 21/24* (2013.01)

(56) References Cited

U.S. PATENT DOCUMENTS 6,870,515 B2 * 3/2005 Kitchener ..... H04B 7/0417 342/361
8,456,374 B1 * 6/2013 Bagley ..... H01Q 21/062 343/795
2006/0132374 A1 6/2006 Wang
2013/0223554 A1 8/2013 Hong et al.

FOREIGN PATENT DOCUMENTS

KR 10-2013-0082353 A 7/2013
KR 10-2013-0097916 A 9/2013
KR 10-2013-0098733 A 9/2013
KR 10-1356789 B1 1/2014

OTHER PUBLICATIONS

Park, D., et al., "Analysis of Pattern Gain of Compact Directional 16-port Antenna," IEEE Antennas and Wireless Propagation Letters, Issue 99, IEEE Antennas and Propagation Society, Dec. 31, 2014, 5 Pages.

* cited by examiner

PATTERN/POLARIZED ANTENNA DEVICE AND BEAMFORMING METHOD

TECHNICAL FIELD

The present invention relates to a pattern/polarized antenna device, and more particularly, to an antenna device for obtaining pattern/polarization gains and a beamforming method using the antenna device.

BACKGROUND ART

A general multi-antenna device is made by arranging a plurality of antennas with the same characteristics at half-wavelength intervals to form beams. The reason of this arrangement is that pattern similarity and physically-short distance between antennas with the same characteristics cause channel characteristics to be similar if they are arranged at intervals not greater than a half-wavelength.

In this case, as a plurality of channels has characteristics similar to each other, it is impossible to implement good characteristics, for example, multiplexing obtained from multiple antennas or robustness against multi-path fading.

Because of the aforementioned disadvantages, there is proposed MIMO (Multiple Input Multiple Output) communication that is carried out by using a plurality of the same or dual-polarized antennas arranged at half-wavelength intervals. However, a disadvantage involved in this arrangement is that it is essential to secure a large space for the antennas because they are arranged at half-wavelength intervals.

Furthermore, since it is necessary to place tens to hundreds of antennas for the ultra-multi-antenna technology, for example, massive MIMO, recently studied, the space for the antennas must be secured.

An antenna radiation pattern $f(\theta,\Phi)$ is defined with the following Equation 1 by using the spherical vector waves mode, orthogonal to each mode:

$$f(\theta, \Phi) = \sum_{\alpha=0}^{\infty} c_\alpha A_\alpha(\theta, \Phi) \quad \text{[Equation 1]}$$

where $A_\alpha(\theta,\Phi)$ represents a spherical vector wave mode, and $c_\alpha$ is the coefficient of a radiation pattern for each spherical vector wave mode.

The MIMO system that employs a conventional multi-antenna device uses just two of the spherical vector wave modes to increase channel capacity because dual-polarization dipole antennas are integrated in the MIMO system.

However, the conventional system gives rise to a problem that pattern/polarization gains are not effectively obtained because it uses just two spherical vector wave modes.

DISCLOSURE

Technical Problem

Therefore, the present invention provides an N-port pattern/polarized antenna device and a beamforming method using the antenna device for obtaining pattern/polarization gains by means of N spherical vector wave modes, rather than just two spherical vector wave modes, in accordance with an embodiment of the present invention.

The foregoing problem of the present invention is not limited thereto and other problems that are not described will be apparent to those skilled in the art from the following detailed description.

Technical Solution

In accordance with an embodiment of the present invention, an N-port pattern/polarized antenna device, wherein two-type antenna elements are configured to have a radiation pattern to use a spherical vector wave mode with at least N orders, the antenna elements being arranged at intervals not larger than a half wavelength between them; and the antenna elements comprise electric field antennas with a radiation pattern distributed in an even mode among the spherical vector wave mode, and magnetic field antennas with a radiation pattern distributed in an odd mode, the electric field antennas and the magnetic field antennas being integrated to face a different direction, each other.

In the embodiment, wherein at least three-type antenna elements are configured to have a radiation pattern to use a spherical vector wave mode with at least N orders, the antenna elements being arranged at intervals not larger than a half wavelength between them; and the antenna elements are integrated in a way that any one of the antennas close each other has a radiation pattern with beamwidth wider than its neighboring antenna element, and the other antenna has a radiation pattern of directivity higher in a given direction than its neighboring antenna.

In accordance with an embodiment of the present invention, a beamforming method using N-port pattern/polarized antennas, wherein at least two-type antenna elements are configured to have a radiation pattern to use a spherical vector wave mode with at least N orders, and M integrated architectures including N-port pattern/polarized antennas make a specific type of array, the N-port pattern/polarized antennas having the antenna elements being arranged at intervals not larger than a half wavelength between them; and beams are formed by using N beamforming antenna groups, which is determined by selecting an antenna among the antennas of each integrated architecture.

In the embodiment, a single beam is formed by applying one beamforming weight set to the one integrated architecture.

In the embodiment, multiple beams are formed by applying a plurality of beamforming weight sets to the one integrated architecture.

In the embodiment, wherein the M-array integrated architecture is any one type of array selected out of one-dimensional linear, two-dimensional planar or three-dimensional stereoscopic array.

In the embodiment, wherein the N-th integrated architecture in the M-array integrated architectures is composed of N pattern/polarized antennas, and the N'-th integrated architecture is composed of N' pattern/polarized antennas.

Advantageous Effects

As described above, according to the embodiment of the present invention, since the N-port pattern/polarized antenna uses N spherical vector wave modes, rather than just two spherical vector wave modes, the pattern/polarization gains are further improved in comparison with the conventional technology.

Also, beamforming by means of such an N-port pattern/polarized antenna contributes to designing a transmission system of low complexity.

BEST MODE

Figure 1:
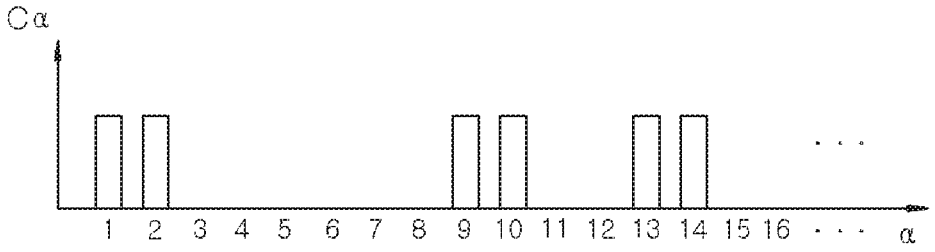
FIG. 1 shows a graph about an analysis of the spherical vector wave mode of a radiation pattern of single-type antenna elements in an N-port pattern/polarized antenna in accordance with an embodiment of the present invention.

The advantages and features of exemplary embodiments of the present invention and methods of accomplishing them will be clearly understood from the following description of the embodiments taken in conjunction with the accompanying drawings. However, the present invention is not limited to those embodiments and may be implemented in various forms. It should be noted that the embodiments are provided to make a full disclosure and also to allow those skilled in the art to know the full scope of the present invention. Therefore, the present invention will be defined only by the scope of the appended claims.

In the following description, well-known functions and/or constitutions will not be described in detail if they would unnecessarily obscure the features of the invention. Further, the terms to be described below are defined in consideration of their functions in the embodiments of the invention and may vary depending on a user's or operator's intention or practice. Accordingly, the definition may be made on a basis of the content throughout the specification.

A mobile communication system based on an N-port pattern/polarized antenna in accordance with an embodiment of the present invention may be composed of distributed nodes and terminal nodes. The distributed nodes and the terminal nodes communicate by means of an integrated architecture and an array architecture of the N-port pattern/polarized antenna in accordance with an embodiment of the present invention. The distributed nodes may form multiple beams by means of the pattern/polarized antenna array architecture with an integration approximately N times higher than a conventional MIMO system, and operate the formed beams by using channel information related to positions, patterns and polarization. The terminal node or base station may obtain diversity gains and multiplexing gains depending on the channel environment by means of the compact integrated architecture and the array architecture of the pattern/polarized antenna.

The N-port pattern/polarized antenna for effectively obtaining pattern/polarization gains in accordance with an embodiment of the present invention needs to be an antenna with a radiation pattern to use at least N spherical vector wave modes.

In the spherical vector wave mode $A_\alpha(\theta,\Phi)$, the order $\alpha$ is defined as $\alpha=2(n(n+1)-1+(-1)^s m)+\tau$, and thus $A_\alpha(\theta,\Phi)=A_{\tau\sigma mn}$. Here, n is a coefficient represented with positive integers, m is a coefficient determined depending on n, and $A_{\tau\sigma mn}$ is a spherical vector wave.

The characteristics of the spherical vector wave mode are very different as n changes. For a TM (Transverse Magnetic) mode, for example, in a loop antenna, the spherical vector wave mode is an even mode, but an odd mode for a TE (Transverse Electric) mode, for example, a dipole antenna. The radiation pattern of a compact antenna has a natural characteristic of the spherical vector wave mode of a low order $\alpha$ with a great coefficient $c_\alpha$. Therefore, it is necessary to use a spherical vector wave mode of the order $\alpha$ equivalent to or greater than N to effectively gain pattern/polarization gains through an N-port antenna.

The following Equation 2 shows characteristics when the spherical vector wave rotates by 90 or 180 degrees around the origin in the modes 1 to 16. This implies that the spherical vector wave mode is converted to another spherical vector wave mode or exhibits the change in phases as it rotates.

$$A'_{\tau e1n}=A_{\tau o1n},\ A''_{\tau e1n}=-A'_{\tau e1n} \text{ for } n=1,2$$

$$A'_{\tau o1n}=-A_{\tau e1n},\ A''_{\tau o1n}=-A_{\tau o1n} \text{ for } n=1,2$$

$$A'_{\tau o0n}=A_{\tau o0n},\ A''_{\tau o0n}=A_{\tau o0n} \text{ for } n=1,2$$

$$A'_{\tau o22}=-A_{\tau o22},\ A''_{\tau o22}=A_{\tau o22} \text{ for } \sigma=e,o. \qquad \text{[Equation 2]}$$

where $A_{\tau\sigma mn}$ is a spherical vector wave and $A'_{\tau\sigma mn}$ is the spherical vector wave rotated by 90 degrees, which are expressed as $\sigma=e$ and $\sigma=0$ for the even mode and the odd mode, respectively.

A conventional pattern/polarized antenna is designed to enable each antenna element to radiate in each different spherical vector wave mode to keep radiation pattern orthogonality of the antenna element. However, it has been found that an N-port pattern/polarized antenna which keeps radiation pattern orthogonality may be designed by using the same type of antenna elements by allowing the antenna elements which radiate in a plurality of spherical vector wave modes to be integrated to be in each different direction by means of the Equation 2. Therefore, it is necessary to ensure a compact antenna element design that allows integration in a small space, and easy integration while implementing radiation pattern orthogonality. Such an antenna element design depends on the channel environment and a given antenna space. The following description is about how many types of antenna elements are used to design an N-port pattern/polarized antenna.

FIG. 1 shows a graph about an analysis of the spherical vector wave mode of a radiation pattern of single-type antenna elements in an N-port pattern/polarized antenna in accordance with an embodiment of the present invention.

It is essential that the antenna elements have a radiation pattern distributed uniformly in an odd mode and an even mode by using the feature of equation 2, when the same type of antenna elements are used to make an N-port pattern/polarized antenna. This type of distribution enables an N-port antenna with a small pattern correlation to be configured because N antenna elements are integrated to face each different direction by using the relationship between the coefficient of odd mode and the coefficient of even mode.

Figure 2A:
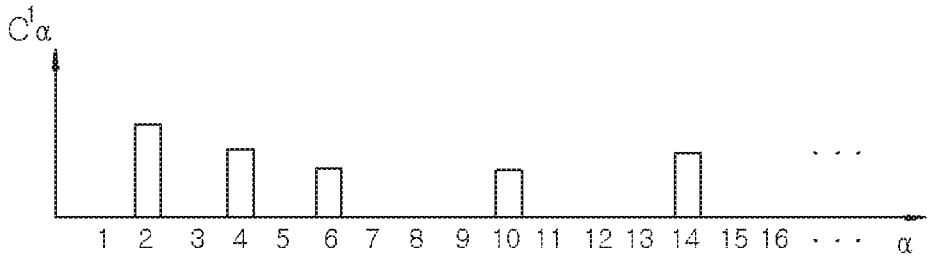
FIGS. 2A and 2B are graphs about an analysis of the spherical vector wave mode of radiation patterns of two-type antenna elements in the N-port pattern/polarized antenna in accordance with an embodiment of the present invention.
Figure 2B:
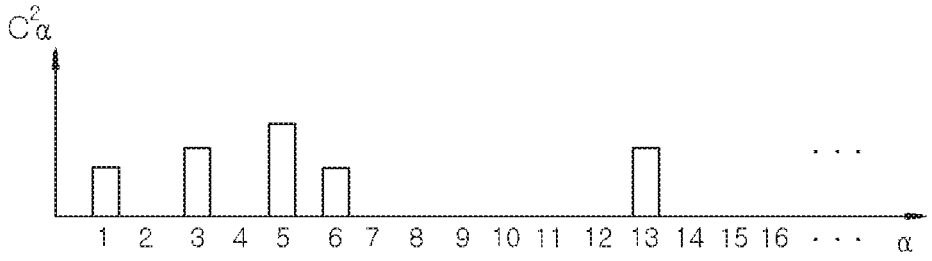

FIGS. 2A and 2B are graphs about an analysis of the spherical vector wave mode of radiation patterns of two-type antenna elements in an N-port pattern/polarized antenna in accordance with an embodiment of the present invention. In FIG. 2A, $C^1_\alpha$ represents a type-1 antenna element, and $C^2_\alpha$ in FIG. 2B represents a type-2 antenna element.

Configuration of an N-port pattern/polarized antenna with two-type antenna elements allows the antenna elements to be divided into electric field antenna elements and magnetic field antenna elements. The electric field antennas have a radiation pattern distributed in the even mode. The magnetic field antennas have a radiation pattern distributed in the odd mode. Since the electric field antenna elements and the magnetic field antenna elements are integrated to face a different direction each other, the even mode and the odd mode keep orthogonality each other to configure an N-port antenna with a small pattern correlation.

Figure 3A:
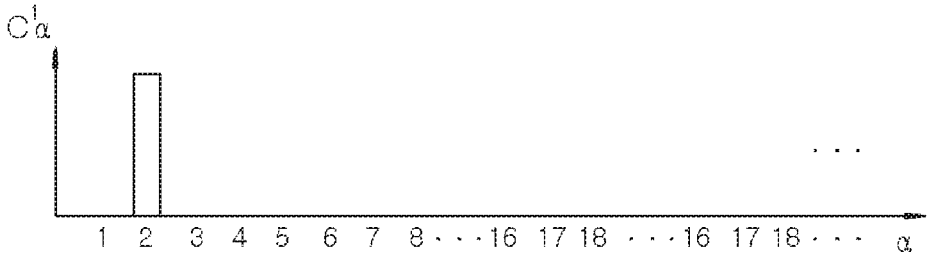
FIGS. 3A, 3B and 3C are graphs about an analysis of the spherical vector wave mode of radiation patterns of multiple-type antenna elements in the N-port pattern/polarized antenna in accordance with an embodiment of the present invention.
Figure 3B:
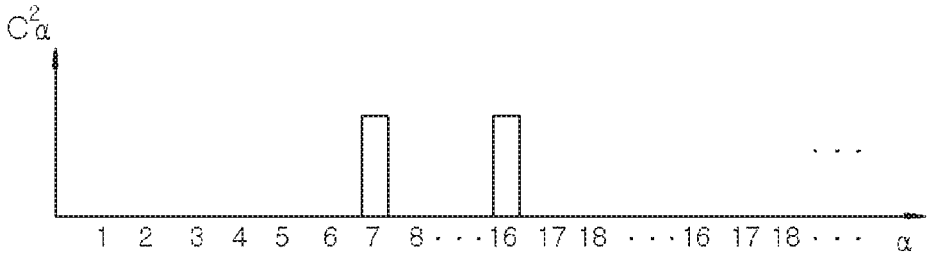
Figure 3C:
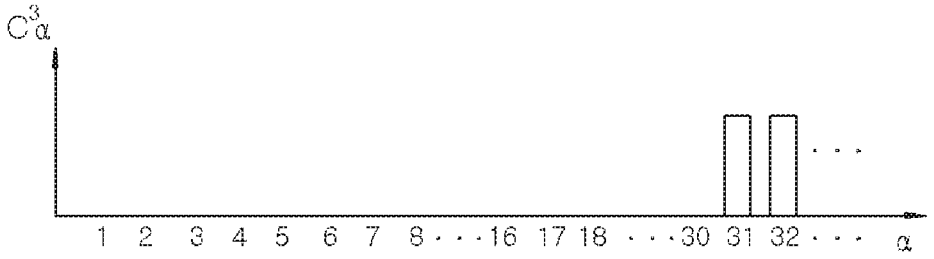

FIGS. 3A, 3B and 3C show graphs about an analysis of the spherical vector wave mode of radiation patterns of multiple-type antenna elements in an N-port pattern/polarized antenna in accordance with an embodiment of the present invention. In FIG. 3A, $C^1_\alpha$ represents a type-1 antenna element; $C^2_\alpha$ in FIG. 3B represents a type-2 antenna element; and $C^3_\alpha$ in FIG. 3C represents a type-3 antenna element.

If an N-port pattern/polarized antenna is designed by using multiple-type antenna elements, the directivity of radiation patterns tends to rise in proportion to the order of modes. It is possible to configure a pattern/polarized antenna of low correlation of the radiation patterns despite of the overlapping radiation pattern architecture by using the relation between the beamwidth and the spectral vector wave modes. When describing an N-port pattern/polarized antenna by using three-type antenna elements like the examples shown in FIGS. 3A, 3B and 3C, the antennas may use the modes 1 to 6 if n=1, the modes 7 to 16 if n=2, and the modes 17 to 32 if n=3. Here, the antenna element $C^2_\alpha$ is narrower than the antenna element $C^1_\alpha$, and the antenna element $C^3_\alpha$ is narrower than the antenna element $C^2_\alpha$ in terms of their beamwidth.

Figure 4:
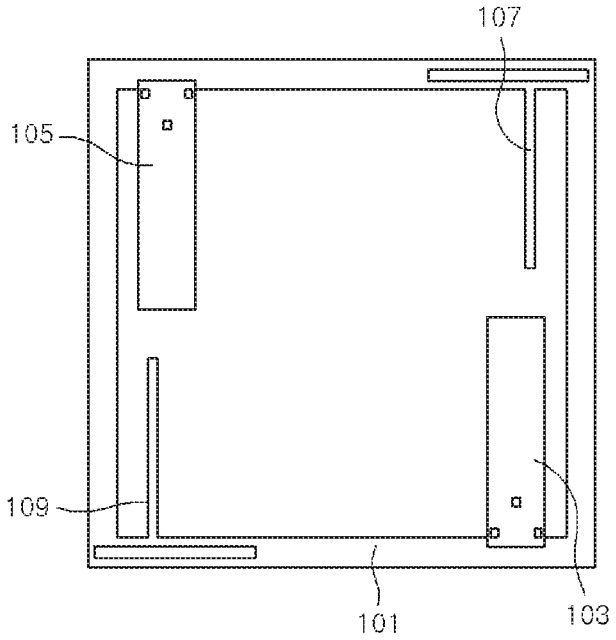
FIG. 4 shows an example of implementing a 4-port planar antenna for the N-port pattern/polarized antenna device in accordance with an embodiment of the present invention.

FIG. 4 shows an example of implementing a 4-port planar antenna for an N-port pattern/polarized antenna device in accordance with an embodiment of the present invention.

In accordance with the embodiment shown in FIG. 4, the electric field antennas 103 and 105 with a radiation pattern distributed in the even mode and the magnetic field antennas 107 and 109 with a radiation pattern distributed in the odd mode are integrated on the substrate 101 to face a different direction each other. In accordance with the embodiment, the electric field antennas 103 and 105 may be implemented as patch antennas, and the magnetic field antennas 107 and 109 as slot antennas.

Figure 5A:
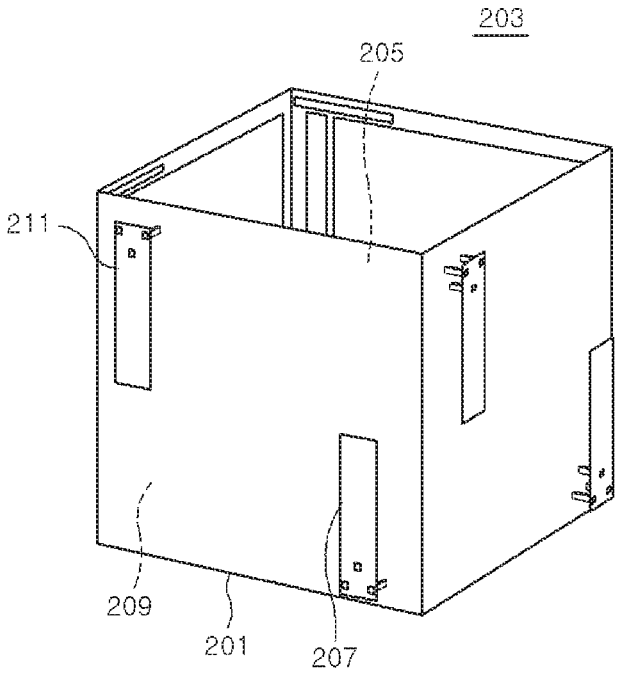
FIGS. 5A and 5B show examples of implementing a 16-port antenna for the N-port pattern/polarized antenna device in accordance with an embodiment of the present invention.
Figure 5B:
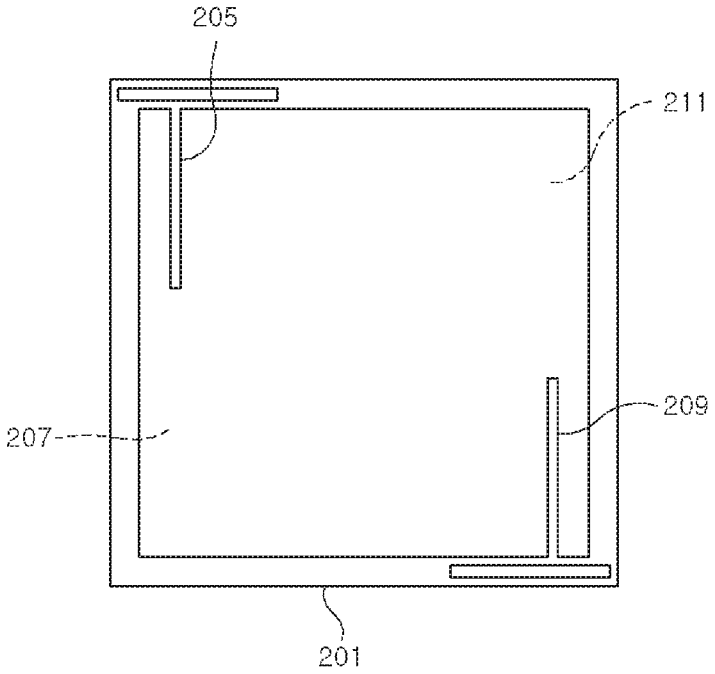

FIGS. 5A and 5B show examples of implementing an N-port pattern/polarized antenna device as 16-port antennas in accordance with an embodiment of the present invention. FIG. 5A shows an example of a polyhedron antenna 203 made by arranging a plurality of rectangular planar antennas 201, and FIG. 5B shows antennas disposed on the rear of a planar antenna 201.

In accordance with the embodiment shown in FIGS. 5A and 5B, a rectangular planar antenna 201, which are arranged to configure the polyhedron antenna 203, may have multiple-type antenna elements 205, 207, 209 and 211 disposed on the front or rear thereof. For example, a slot-type antenna element 205 has a radiation pattern that has beamwidth wider than a strip-type antenna element 207. The strip-type antenna element 207 close to the antenna 205 has a radiation pattern of higher directivity in a given direction than the slot-type antenna element 205.

FIG. 5A shows an example of a polyhedron antenna 203 implemented in a way that a plurality of rectangular planar antennas 201 is placed in the right and left directions. However, it is also allowed to dispose the planar tetragonal antennas 201 in a different direction, for example, upward and downward or diagonal directions, to implement the polyhedron antenna 203.

The N-port pattern/polarized antenna in accordance with an embodiment of the present invention may be extended as an array architecture depending on a given channel environment or communication system. The array architecture of the N-port pattern/polarized antenna has features described below. The two-dimensional or three-dimensional N-port pattern/polarized antenna may be arranged at given intervals to be extended into a one-dimensional, two-dimensional or three-dimensional space. The N-port pattern/polarized antenna and the array architecture thereof depend on the channel environment that includes features about both azimuth angles and elevation angles. Therefore, it is possible to obtain the gains with the antenna array architecture with various radiation patterns, not effectively obtained by a conventional MIMO. In particular, the extended array architecture in which the N-dimensional pattern/polarized antenna is extended into a three-dimensional space is ideal for the environment in which both distribution and reflection occur a lot in the directions x, y and z, and may obtain a high transmission capacity close to the upper bound in relation to a given antenna space.

In accordance with an embodiment of the present invention, the integrated architecture composed of the N-port pattern/polarized antennas may be used to form beams. To this end, the integrated architecture is composed of the N-port pattern/polarized antennas, and the distance between them is not larger than a half wavelength. Although the physical distance between them is not larger than a half wavelength, the antennas exhibit each different channel characteristics because each antenna has its own pattern/polarization characteristics. Therefore, it is possible to use N-port patterns/polarization antennas in a one integrated architecture to form beams and then send/receive signals.

First, all N-port pattern/polarized antennas in one integrated architecture may be used to form beams. The N-port antennas in a one integrated architecture are expressed with the Equation 3.

$$a^H=[a_1,a_2,\ldots,a_n,\ldots,a_{N-1},a_N]^H \quad \text{[Equation 3]}$$

where 1 to N represent each N-port antenna, and N is a natural number.

Figure 6:
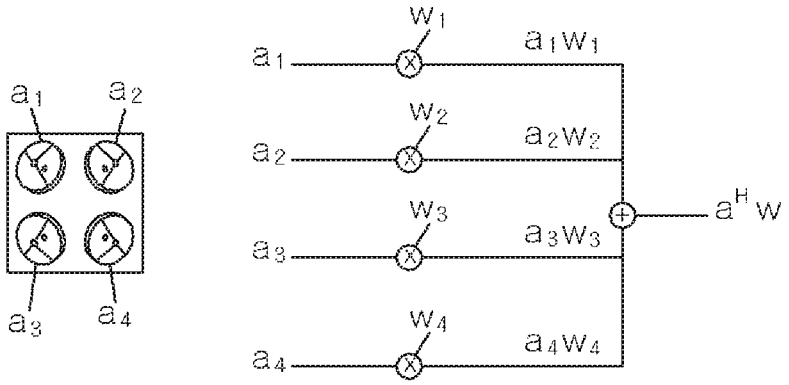
FIG. 6 shows a beamforming state illustrating a scheme for forming a single beam by using the N-port pattern/polarized antennas in an integrated architecture in accordance with an embodiment of the present invention.

FIG. 6 shows a beamforming state illustrating a scheme for forming a single beam by using the N-port pattern/polarized antennas in an integrated architecture in accordance with an embodiment of the present invention.

As shown in FIG. 6, it is possible to form one beam by using all N-port pattern/polarized antennas and then applying one beamforming weight set. This is expressed with the Equation 4.

$$a^H w = [a_1, \ldots, a_n, \ldots, a_N]^H \begin{bmatrix} w_1 \\ \vdots \\ w_n \\ \vdots \\ w_N \end{bmatrix} \quad \text{[Equation 4]}$$

where $w_n$ represents a beamforming weight for the n-th antenna $a_n$.

Figure 7:
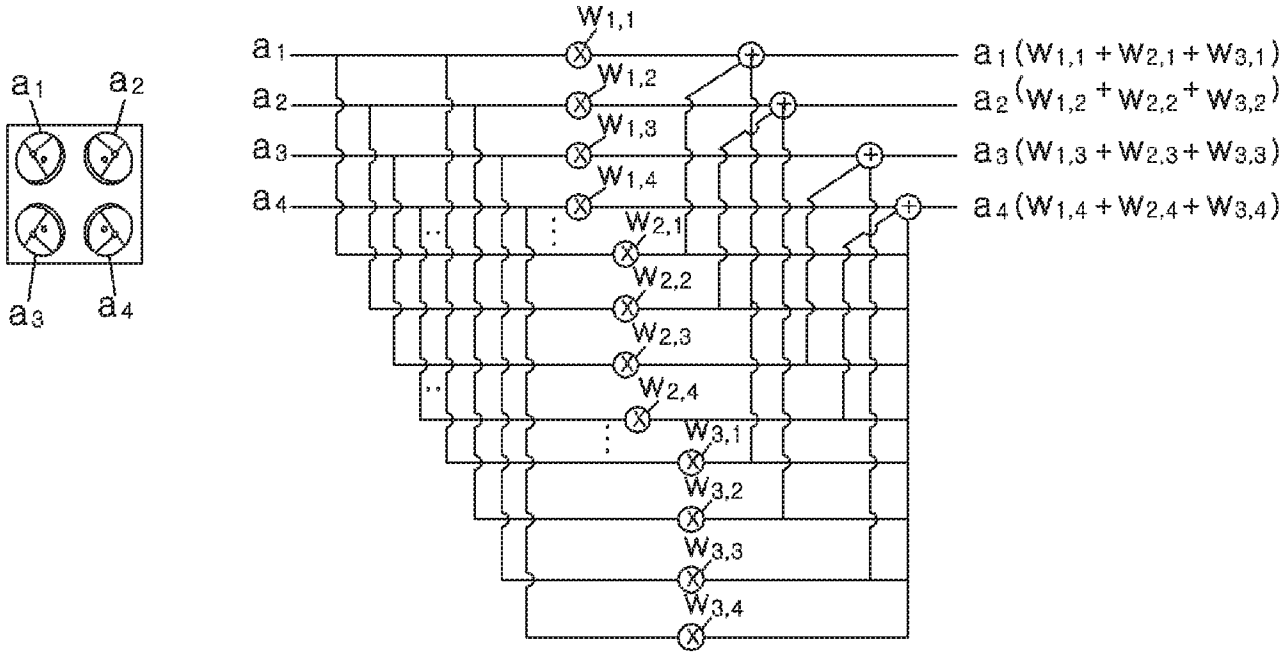
FIG. 7 shows a beamforming state illustrating a scheme for forming multiple beams by using a beamforming weight set of the N-port pattern/polarized antennas in an integrated architecture in accordance with an embodiment of the present invention.

FIG. 7 shows a beamforming state illustrating a scheme for forming multiple beams by using a beamforming weight set of the N-port pattern/polarized antennas in an integrated architecture in accordance with an embodiment of the present invention.

As shown in FIG. 7, it is possible to form multiple beams while using all N-port pattern/polarized antennas through the principle of superposition after making a plurality of beamforming weight sets. This is expressed with the Equation 5.

$$a^H w = a^H(w_1 + \ldots + w_k + \ldots + W_K) = [a_1, \ldots, a_n, \ldots, a_N]^H \left( \begin{bmatrix} w_{1,1} \\ \vdots \\ w_{1,n} \\ \vdots \\ w_{1,N} \end{bmatrix} + \ldots + \begin{bmatrix} w_{k,1} \\ \vdots \\ w_{1k,n} \\ \vdots \\ w_{k,N} \end{bmatrix} + \ldots + \begin{bmatrix} w_{1,1} \\ \vdots \\ w_{1,n} \\ \vdots \\ w_{1,N} \end{bmatrix} \right). \quad \text{[Equation 5]}$$

where $w_k$ represents a k-th beamforming weight set. Also, $w_{k,n}$ represents a beamforming weight for the antenna an in the k-th beamforming weight set.

In accordance with an embodiment of the present invention, it is possible to select some out of the N-port pattern/polarized antennas arranged in one integrated architecture to form beams. In this case, exemplary selections include the cases of consideration of channel situations, consideration of characteristics of the pattern/polarized antennas, and consideration of characteristics of communication counterparty's antennas. Here, it is possible to select some out of the N-port pattern/polarized antennas to apply one beamforming weight set to form a beam. It is also allowed to make several beamforming weight sets, and then assign each beamforming weight set to different antenna element set which are selected out of N-port pattern/polarized antennas, so that the multiple beams are formed by implementing superposition of the beamforming weight sets.

Figure 8:
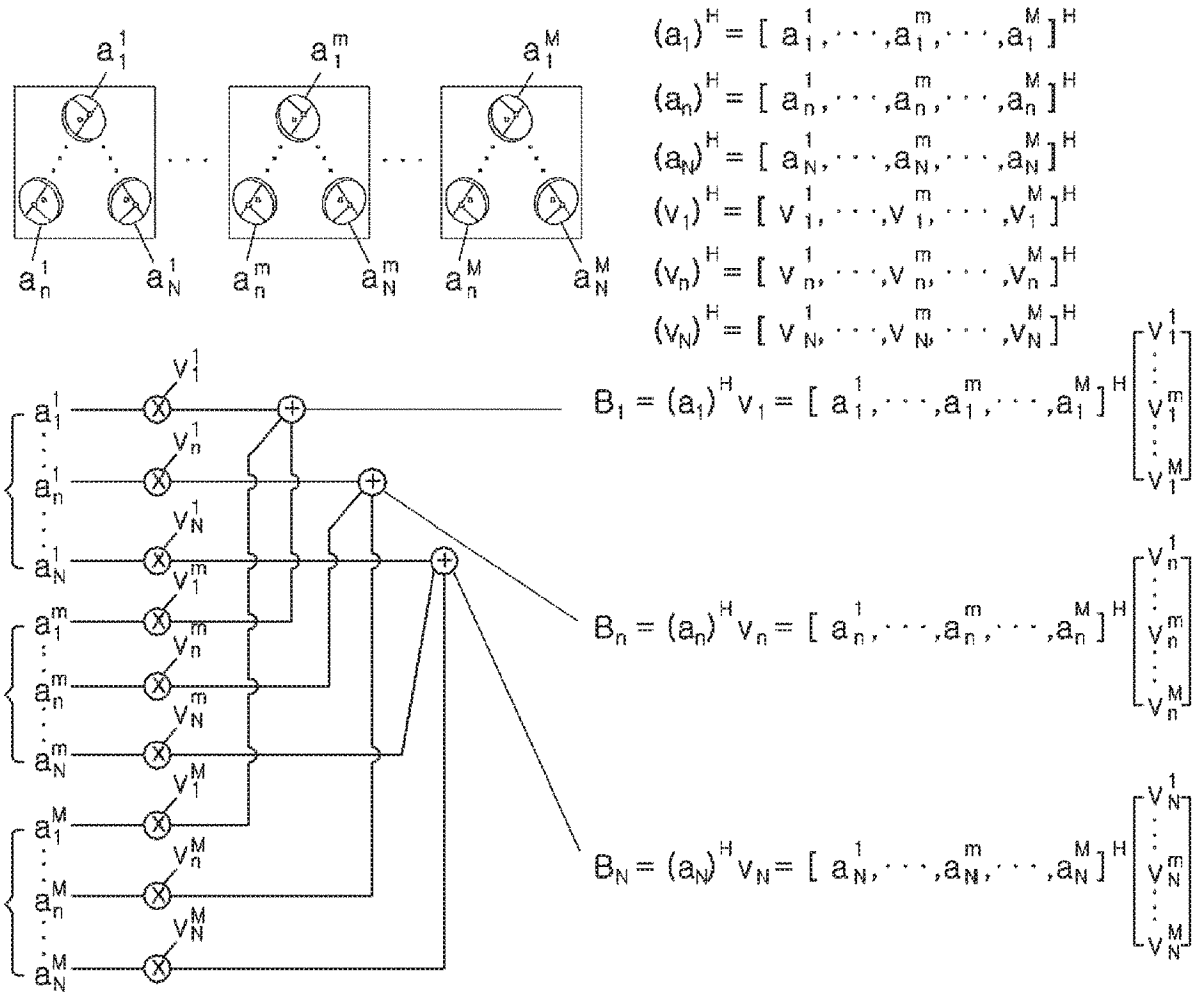
FIG. 8 shows a beamforming state illustrating a scheme for forming multiple beams by using the N-port pattern/polarized antennas in an integrated architecture and an M-array architecture in accordance with an embodiment of the present invention.

FIG. 8 shows a beamforming state illustrating a scheme for forming multiple beams by using the N-port pattern/polarized antennas in an integrated architecture and an M-array architecture in accordance with an embodiment of the present invention.

As shown in FIG. 8, it is possible to use an integrated architecture composed of N-port pattern/polarized antennas, and an array architecture in which M integrated architectures are placed, to form beams. It is possible to form the array architecture in an integrated architecture by placing the integrated architecture of N-port pattern/polarized antennas at given intervals. Here, the array architecture may be any one of various types of array architectures, for example, one-dimensional linear type, two-dimensional planar type and three-dimensional type.

Each of integrated architectures for the array architecture may be the same integrated architecture in order to make the array architecture by using the integrated architecture. That is, the array architecture is made by arranging modules at given intervals, one module being made with a specific integrated architecture.

Each of integrated architectures has N-port pattern/polarized antennas arranged therein, and the same M integrated architectures makes a specific type of array to implement array architecture. This is expressed with the Equation 6.

$$a^H = [a^1 \ldots a^m \ldots a^M]^H \text{ where, } (a^m)^H = [a_1^m, \ldots, a_n^m, \ldots, a_N^m]^H \quad \text{[Equation 6]}$$

where $a^m$ represents an integrated architecture m arranged on the m-th place of the array architecture. The N-port pattern/polarized antenna arranged in the m-th integrated architecture $a^m$ is be represented as $a_1^m, \ldots, a_n^m, \ldots, a_N^m$, respectively.

In accordance with an embodiment of the present invention, it is possible to make a beamforming group made with pattern/polarized antennas with the same characteristics in each of integrated architectures making an array architecture to form beams. That is, it is to select antennas n with the same pattern/polarization characteristics out of each of integrated architectures (1 to M) making an array architecture, for example, $(a_n)^H = [a_n^1, \ldots, a_n^m, \ldots, a_n^M]^H$ to combine them as one beamforming antenna group. Therefore, beams may be formed by using N beamforming antenna groups which use pattern/polarized antennas with the same characteristics. Beams may be formed by using both the N-port pattern/polarized antennas in the integrated architecture and M array architectures by means of a beamforming scheme for using all N beamforming antenna groups. This is expressed with the Equation 7.

$$B_1 = (a_1)^H v_1 = [a_1^1, \ldots, a_1^m, \ldots, a_1^M]^H \begin{bmatrix} v_1^1 \\ \vdots \\ v_1^m \\ \vdots \\ v_1^M \end{bmatrix} \quad \text{[Equation 7]}$$

$$B_n = (a_n)^H v_n = [a_n^1, \ldots, a_n^m, \ldots, a_n^M]^H \begin{bmatrix} v_n^1 \\ \vdots \\ v_n^m \\ \vdots \\ v_n^M \end{bmatrix}$$

$$B_N = (a_N)^H v_N = [a_N^1, \ldots, a_N^m, \ldots, a_N^M]^H \begin{bmatrix} v_N^1 \\ \vdots \\ v_N^m \\ \vdots \\ v_N^M \end{bmatrix}$$

where $B_n$ represents a beam made by using the n-th pattern/polarized antenna in each integrated architecture, and $a_n$ represents a beamforming antenna group composed of n-th pattern/polarized antennas in each integrated architecture, with $a_n = [a_n^1, \ldots, a_n^m, \ldots, a_n^M]^H$. Also, $v_n$ represents a beamforming weight vector for the n-th beamforming antenna group, and $v_n^m$ is a beamforming weight for the n-th pattern/polarized antenna in the m-th array architecture.

In accordance with an embodiment of the present invention, beams may be formed by using just some antennas selected out of the beamforming antenna group $[a_n^1, \ldots, a_n^m, \ldots, a_n^M]$, using just some groups selected out of N beamforming groups, or using just some antennas selected out of just some groups selected out of the beamforming groups while using the selected groups as a combined case of the aforementioned two selection schemes.

Each of integrated architectures has N-port pattern/polarized antennas arranged therein, and the same M integrated architectures make an array architecture of a specific type of array. In this example, it is possible to form beams by setting up pattern/polarized antennas with the same characteristics as a beamforming antenna set to form a beam $[a_n^1, \ldots, a_n^m, \ldots, a_n^M]$ as described above, and setting up pattern/polarized antennas with different characteristics as a beamforming antenna group. For example, it is possible to form beams by changing one antenna with a p-th pattern/polarized antenna to set up a beamforming antenna group like $[a_n^1, \ldots, a_p^m, \ldots, a_n^M]$, or various types of pattern/polarized antennas as a beamforming antenna group like $[a_p^1, \ldots, a_q^m, \ldots, a_r^M]$.

In accordance with an embodiment of the present invention, it is possible to form beams by using both all M integrated architectures making an array architecture and the N-port pattern/polarized antennas making the integrated architecture when setting up various pattern/polarized antennas with different characteristics each other as a beamforming group to form beams.

Each integrated architecture making the array architecture may be of a different type each other. For example, the n-th integrated architecture may be composed of N pattern/polarized antennas, and the N'-th integrated architecture may be composed of N' pattern/polarized antennas. Examples of the different type may include the cases where the N pattern/polarized antennas and the N' pattern/polarized antennas become a subset of the other antennas, have just some antennas as an intersection, or are composed of totally different pattern/polarized antennas each other.

The explanation as set forth above merely describes a technical idea of the exemplary embodiments of the present invention, and it will be understood by those skilled in the art that various changes and modifications may be made without departing from the scope of the essential characteristics of the embodiments of the present invention. Therefore, the exemplary embodiments disclosed herein are not used to limit the technical idea of the present invention, but to explain the present invention, and the scope of the technical idea of the present invention is not limited to these embodiments. Therefore, the scope of protection of the present invention should be construed as defined in the following claims and changes, modifications and equivalents that fall within the technical idea of the present invention are intended to be embraced by the scope of the claims of the present invention.

The invention claimed is:

1. A beamforming method using M integrated architectures including N-port pattern/polarized antennas, comprising:

forming beams by using N beamforming antenna groups, one of the N beamforming antenna groups made by selecting an antenna among the N-port pattern/polarized antennas included in each of the M integrated architectures, wherein the M integrated architectures make a specific type of array, wherein the beams are formed by applying a plurality of beamforming weight sets to the each of M integrated architectures, and wherein the N-port pattern/polarized antennas comprise at least two-type antenna elements configured to have a radiation pattern to use a spherical vector wave mode with at least N orders, the at least two-type antenna elements being arranged at intervals not larger than a half wavelength between them.

2. The beamforming method according to claim 1, wherein the M-array integrated architecture is any one type of array selected out of one-dimensional linear, two-dimensional planar or three-dimensional stereoscopic array.

3. The beamforming method according to claim 1, wherein the N-th integrated architecture in the M-array integrated architectures is composed of N pattern/polarized antennas, and the N'-th integrated architecture is composed of N' pattern/polarized antennas.

* * * * *